US005179389A

United States Patent [19]

Arai et al.

[11] Patent Number: 5,179,389

[45] Date of Patent: Jan. 12, 1993

[54] INK JET RECORDING WITH HEAD DRIVING CONDITION REGULATION

[75] Inventors: Atsushi Arai, Kasukabe; Hiromitsu Hirabayashi, Yokohama; Hiroshi Tajika, Yokohama; Noribumi Koitabashi, Yokohama, all of Japan

[73] Assignee: Canon Kabushiki Kaisha, Tokyo, Japan

[21] Appl. No.: 470,589

[22] Filed: Jan. 26, 1990

[30] Foreign Application Priority Data

Jan. 28, 1989 [JP] Japan ..... 1-19073

[51] Int. Cl.[5] ..... B41J 2/05

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 3,832,579 | 8/1974 | Arndt | 346/140 X |
| 4,313,124 | 1/1982 | Hara . | |
| 4,345,262 | 8/1982 | Shirata et al. . | |
| 4,459,600 | 7/1984 | Sato et al. . | |
| 4,463,359 | 7/1984 | Ayata et al. . | |
| 4,542,385 | 9/1985 | Jinnai | 346/75 |
| 4,544,931 | 10/1985 | Watanabe | 346/140 |
| 4,558,333 | 12/1985 | Sugitani et al. . | |
| 4,589,000 | 5/1986 | Koto | 346/140 |
| 4,636,814 | 1/1987 | Terasawa . | |
| 4,723,129 | 2/1988 | Endo et al. . | |
| 4,740,796 | 4/1988 | Endo et al. . | |
| 4,777,497 | 10/1988 | Nozu et al. . | |
| 4,860,034 | 8/1989 | Watanabe | 346/140 |
| 4,872,028 | 10/1989 | Lloyd | 346/140 X |
| 4,947,194 | 8/1990 | Kyoshima | 346/140 |

FOREIGN PATENT DOCUMENTS

| | | |
|---|---|---|
| 221703 | 5/1987 | European Pat. Off. . |
| 229978 | 7/1987 | European Pat. Off. . |
| 59-123670 | 7/1984 | Japan . |
| 59-138461 | 8/1984 | Japan . |
| 230861 | 11/1985 | Japan . |

*Primary Examiner*—Joseph W. Hartary
*Attorney, Agent, or Firm*—Fitzpatrick, Cella, Harper & Scinto

[57] ABSTRACT

An ink jet recording apparatus provided with an ink jet recording head connected to an ink tank and having ink discharge ports and energy generating members for generating ink discharge energy, in which the head pressure of ink at the discharge ports is detected and the driving condition of the energy generating members is regulated according to the detected head pressure, thus achieving stable ink discharge regardless of the change in a head pressure and improving the efficiency of utilization of ink in the ink tank.

12 Claims, 8 Drawing Sheets

INK JET RECORDING WITH HEAD DRIVING CONDITION REGULATION

BACKGROUND OF THE INVENTION

1. Field of the Invention

The present invention relates to an ink jet recording apparatus for image recording by discharging recording liquid (ink) from a discharge port of a recording head, an ink jet recording head adapted for use in such apparatus, and an ink jet recording method adapted for use in such apparatus.

2. Related Background Art

FIGS. 6, 7A and 7B show an example of conventional ink jet recording apparatus utilizing an ink tank incorporating an ink absorbent member.

The recording means employed in this apparatus is of cartridge type in which a recording head 100 and and ink tank 200 are integrally constructed and are detachably mounted on a carriage. The ink tank 200 of the cartridge houses an ink absorbent member 202, and ink impregnated and contained therein is supplied to the recording head 100.

In FIG. 7B, a recording head chip 100 comprises a discharge unit 102, a supply tank 104, etc. The discharge unit 102 is provided with discharge ports 102A formed on a face opposed to the recording medium, liquid paths extended inwardly therefrom, recording heaters provided as discharge energy generating members respectively in the liquid paths, and a common liquid chamber communicating with the liquid paths. The supply tank 104 serves as a subsidiary tank for receiving the ink from the ink tank 200 and guiding the ink to the common liquid chamber of the discharge unit 102.

The ink absorbent member 202, provided in the ink tank 200 and impregnated with ink, can be composed of a porous material or a fibrous material. A cover member 204 is provided for the ink tank 200.

Referring to FIG. 6, recording head cartridges 14 of the form shown in FIG. 7A are positioned and fixed on a carriage 14 by means of pressing members 41 and are capable of reciprocating along guide shafts 21, in a longitudinal direction, perpendicular to the advancing direction of the recording material. The positioning on the carriage 15 can be achieved, for example, by mutual engagement or mutual pressing of positioning parts formed on the recording head cartridge 14 and the carriage 15. Also, an electrical connection can be made by coupling a connection pad of a printed wiring board (not shown) for the discharge unit 102 with a connector on the carriage 15.

The ink discharged from the discharge ports of the recording head cartridge 14 reaches the recording material 18 which is conveyed by conveying means. The recording face of the recording material 18 is defined by a platen 19 at a small distance from the discharge face of the recording head cartridge 14, and a desired image can be recorded by the relative movement of the recording material 18 and scanning of the recording head cartridge 14. The conveyance of the recording material may be performed by a known conveying mechanism, either by an independent motor or a motor used for carriage driving or for driving of a recovery unit for the recording head.

The recording head cartridge 14 receives discharge signals corresponding to image data from a suitable data source, through a cable 16 and terminals thereof. There may be provided one or plural recording head cartridges 14 (two cartridges 14 are provided in the drawing), according to the characteristics required in the recording, for example mono-color recording, recording with continuous density or full-color recording.

In FIG. 6, there are further shown a carriage motor 17 for moving the carriage 15 along the shafts 21, a wire 22 for transmitting the driving force of the motor 17 to the carriage 15, and a feed motor 20 coupled with the platen roller 19 for conveying the recording material 18.

In the above-explained recording ink cartridge in which the ink tank and the recording head are mutually connected, a negative pressure acts on the ink in the recording head, due to the capillary action of the ink absorbent member of the ink tank, thus applying a force to suck the ink from the recording head side toward the absorbent member in the ink tank. Thus, the balance between the negative pressure and the sucking pressure resulting from the capillary action of the liquid paths of the recording head side meniscuses the ink surfaces in the discharge ports.

In such recording means in which the meniscus of ink is maintained by the balance of the capillary action of the ink tank side provided with the ink absorbent member and the capillary action of the ink paths of the recording head side, the liquid head pressure at the discharge ports varies according to the amount of ink in the ink tank, due to the change in the negative pressure applied from the ink tank side to the ink paths communicating with the discharge ports.

The remaining amount of ink in the ink tank and the head pressure of ink at the discharge port are generally correlated as indicated in FIG. 8. More specifically, the head pressure at the discharge port is lowered with a decrease in the remaining amount of ink in the ink tank.

In FIG. 8, the curves a and b indicate "behaviors" of the head pressure with absorbent materials of different absorbent abilities, whereby the curve b respresents a larger absorbent ability. It will be understood that the change in the head pressure becomes larger as the absorbent ability increases. Also FIG. 9 shows the relationship between the head pressure and the amount of ink discharge (quantity per ink droplet) from the discharge port of the recording head. The ink discharge amount gradually decreases with the decrease of the head pressure and may become zero at a certain head pressure. Such a phenomenon is caused by the decrease of head pressure at the discharge port, resulting from an increase of the negative pressure in the ink tank, caused by the decrease of the remaining amount of ink in the ink tank. This is because an increase in the negative pressure of the ink tank side destroys the balance of pressure between the ink tank side and the discharge port side, thus increasing the sucking force on the ink toward the ink tank side. Such increased sucking force on the ink toward the ink tank side reduces the ink discharge amount, if the ink discharge power given to the recording head is maintained constant. With a further decrease in the ink head pressure, the capillary absorbing force of the ink paths becomes comparable to the negative pressure, so that the flow into the ink paths after ink discharge is retarded, thus prolonging the ink refill time, required for replenishing the discharged ink. Since sufficiently rapid refilling cannot therefore be achieved with a constant driving frequency, the ink discharge amount decreases rapidly, and ink discharge may eventually become impossible even though the ink remains in the ink tank.

FIG. 10 shows the relationship between the head pressure and the refilling frequency.

As explained in the foregoing, in an ink jet recording apparatus utilizing a cartridge in which an ink tank incorporating an ink absorbent member and a recording head are integrally connected, there may be encountered a variation in the ink discharge amount depending on the remaining amount of ink in the ink tank. Such variation in the ink discharge amount is directly reflected in the density of the printed image, and is often regarded as a technical problem to be solved in an image output apparatus used for halftone images.

Also, as will be understood from the curves in FIG. 8, the use of an ink absorbent material with a larger absorbent ability for the purpose of increasing the ink amount contained in the ink tank, thereby reducing the operating cost at the device, will result in a larger variation in the ink discharge amount, thus influencing to an even greater extent the density or contrast of the printed image.

Also, before the ink in the ink tank can be efficiently used up, the negative pressure of the ink tank side may increase to disable the ink discharge, thus reducing the efficiency of ink utilization.

SUMMARY OF THE INVENTION

An object of the present invention is to provide a method, in an ink jet recording apparatus utilizing an ink tank incorporating an ink absorbent member as explained above, for eliminating the effect of the ink remaining amount in the ink tank on the ink discharge characteristics, and an ink jet recording apparatus utilizing such a method.

Another object of the present invention is to provide an ink jet recording apparatus provided with a recording head including ink discharge ports connected to an ink tank containing ink and serving to discharge the ink supplied from the ink tank, discharge energy generating members for generating energy for discharging the ink from the discharge ports, and means for feeding a recording material on which an image is to be recorded by the ink discharged from the discharge ports of the recording head, comprising means for detecting the head pressure of the ink at the discharge ports and means for regulating the drive condition of the discharge energy generating members according to the head pressure detected by the head pressure detecting means.

Still another object of the present invention is to provide an ink jet recoding head connected integrally with an ink tank containing ink and provided with discharge ports for discharging the ink supplied from said ink tank and discharge energy generating members for generating energy to be utilizing for ink discharge from the discharge ports, comprising means for detecting the head pressure of the ink at the discharge ports.

Still another object of the present invention is to provide an ink jet recording method for achieving image recording by driving discharge energy generating members of the recording head according to the recording information thereby discharging the ink from discharge ports, comprising regulating of the driving condition of the discharge energy generating members acording to the head pressure of the ink at the discharge ports.

Thus, according to the present invention, the driving condition of the recording head is controlled according to the change in the head pressure at the discharge ports of the recording head, thereby securing desired ink discharge condition at the discharge ports.

It is therefore rendered possible to always discharge of ink, thereby realizing uniform image density, regardless of the amount of ink remaining in the ink tank. Also, the efficiency of ink can be utilized from the ink tank.

DETAILED DESCRIPTION OF THE PREFERRED EMBODIMENTS

Now the present invention will be clarified in greater detail by embodiments thereof shown in the attached drawings.

1st Embodiment

Figure 1:
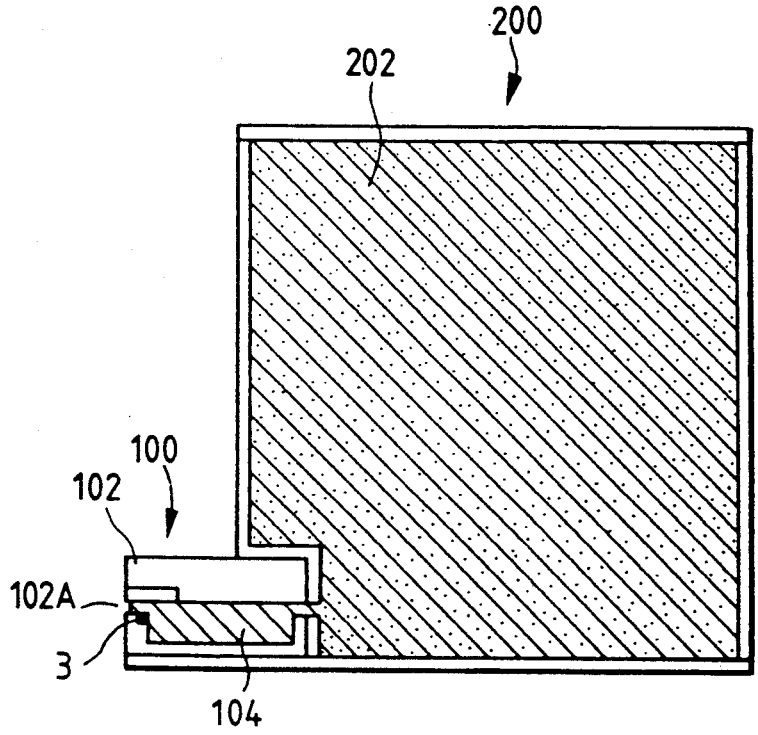
FIGS. 1, 3 and 5 are partial views of an embodiment of the ink jet recording apparatus of the present invention.
Figure 11:
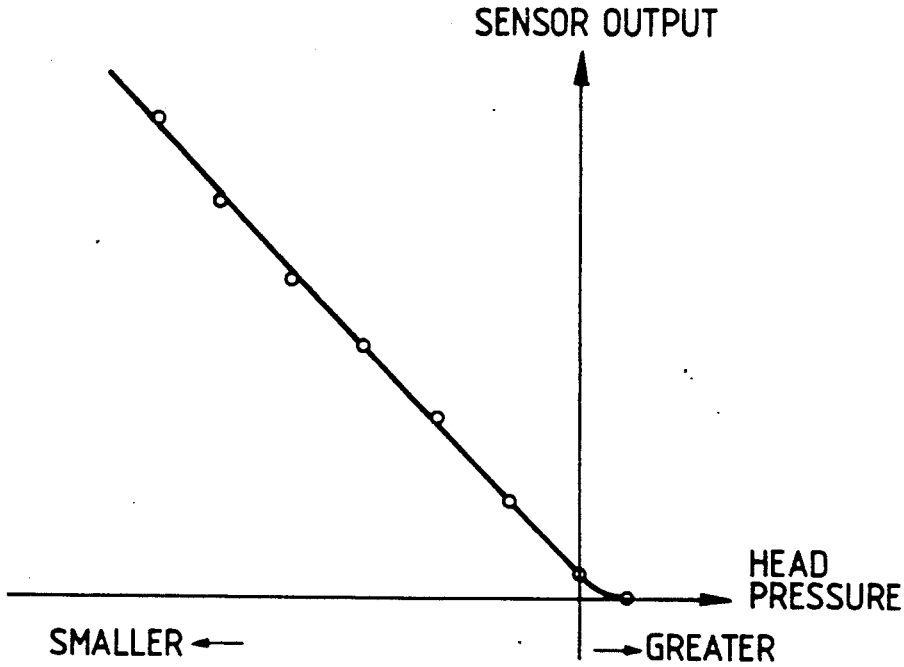

FIG. 1 is a cross-sectional view of an ink jet recording head cartridge in which an ink tank and a recording head are integrally provided, constituting a first embodiment of the present invention. In this embodiment, there is provided a pressure sensor 3 including a piezoelectric material provided in a predetermined position of a supply tank 104, so as to be in contact with the ink. The pressure sensor serves as pressure detecting means for detecting the pressure of the ink in the supply tank 104 and converting the pressure into an electrical signal. Thus, the head pressure of the ink at the discharge ports 102A can be indirectly detected, by correlating the output signal of the sensor with the head pressure in advance. FIG. 11 shows an example of the relationship between the output signal of the pressure sensor 3 and the head pressure of the ink at the discharge ports 102A. The output signal of the pressure sensor 3 is supplied to a means for varying the driving pulse width not shown.

Figure 7A:
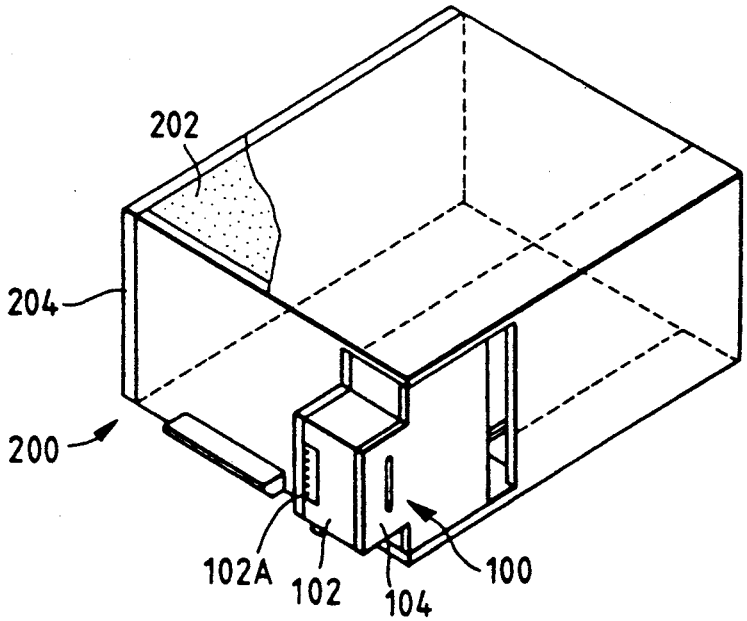
FIG. 7A PRIOR ART
FIG. 7A is a magnified perspective view of a recording head connected to an ink tank, adapted for use in the apparatus shown in FIG. 6.
Figure 7B:
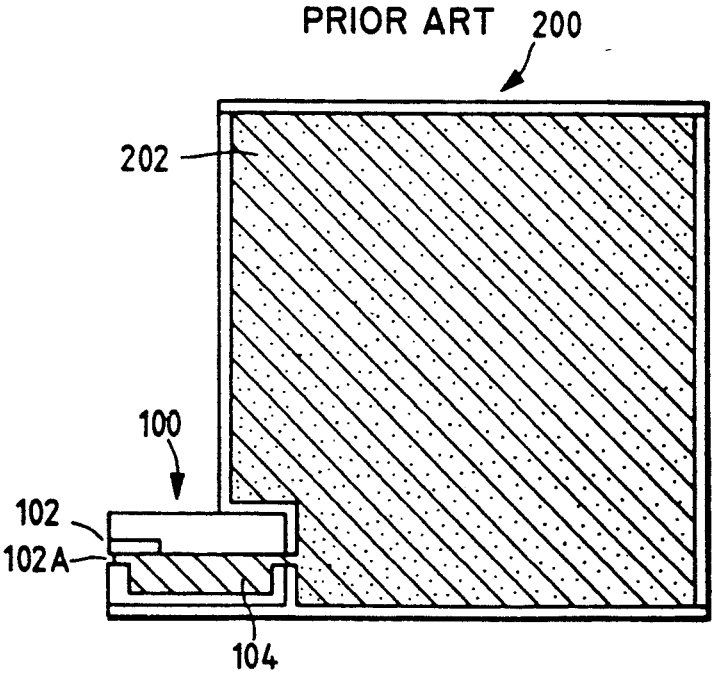
FIG. 7B PRIOR ART
FIG. 7B is a cross-sectional view of the recording head shown in FIG. 7A.

The structure shown in FIG. 1, except the pressure sensor 3, is same as that shown in FIG. 7B.

In the apparatus shown in FIG. 1, the driving condition of the recording head, for example the pulse duration or frequency of the recording signal supplied to the discharge energy generating members (for example electrothermal converting members) for generating thermal energy for causing ink discharge from the recording head 100 is varied according to the head pressure indirectly detected by the pressure sensor 3, thereby obtaining a desired discharge state with a discharge pressure responding to the change in the head pressure.

Figure 2:
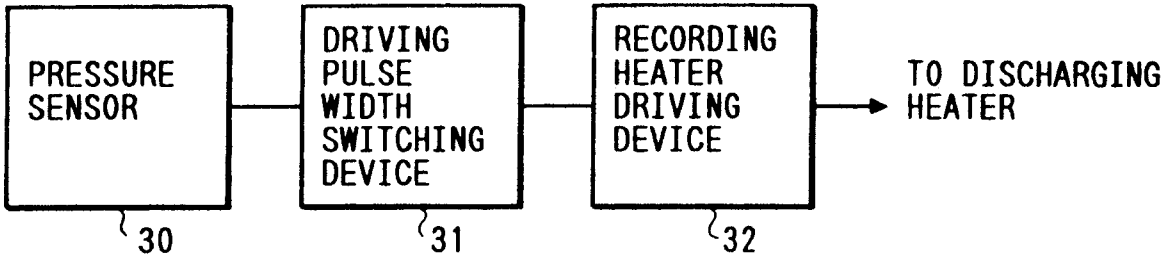
FIGS. 2 and 4 are block diagrams showing examples of method for controlling the driving condition of the recording head according to the present invention.

FIG. 2 shows a block diagram for varying the duraton of driving pulses for the recording head, in the first embodiment of the present invention, wherein shown are the above-mentioned pressure sensor 30; a pulse width switching device 31; and a recording heater driving device 32. The output signal of the pressure sensor, representing the head pressure of ink at the discharge ports, is digitized by an A/D (analog-to-digital) converter in the switching device 31, and the width of the driving pulses is determined by a predetermined conversion table between the output signal of the pressure sensor and the pulse width for maintaining a constant ink discharge amount.

Figure 9:
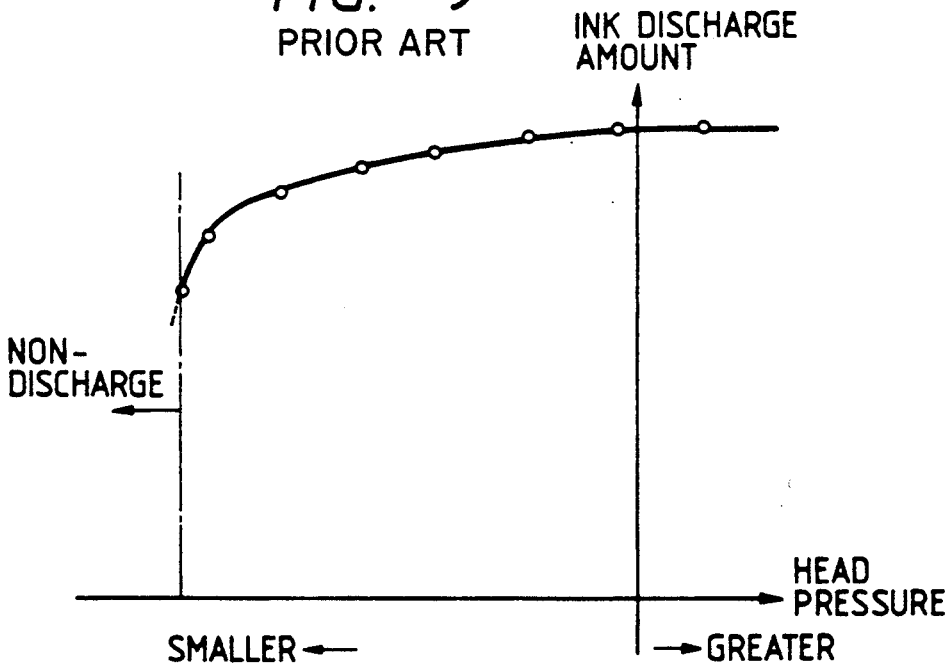
FIG. 9 PRIOR ART
Figure 12:
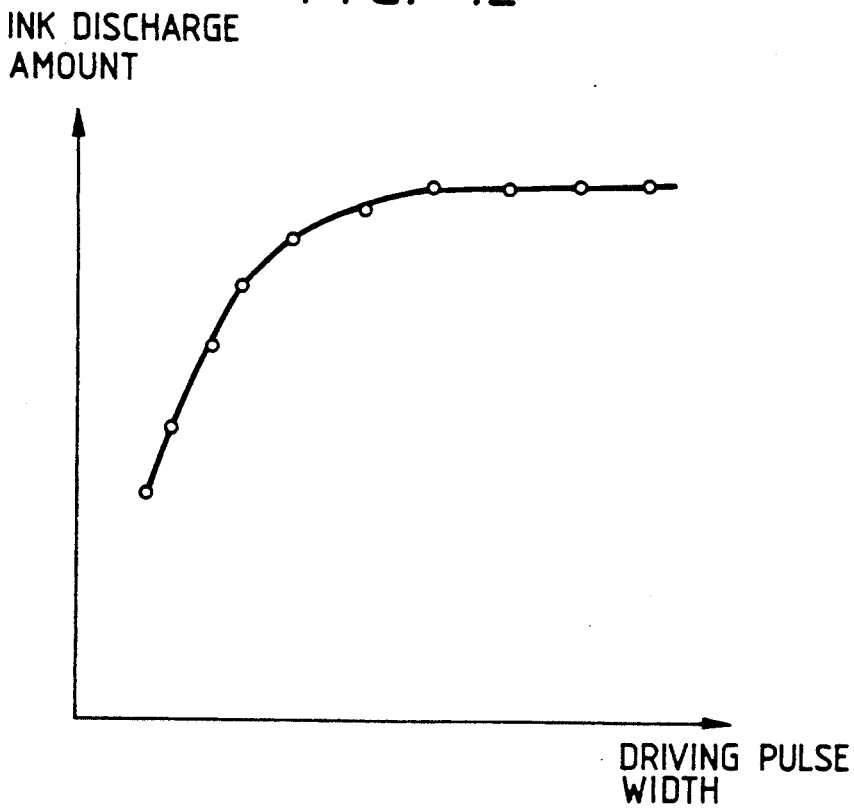

FIG. 12 shows an example of the relationship between the driving pulse width and the ink discharge amount. The conversion table of the output signal of the pressure sensor and the driving pulse width can be prepared from the relationships shown in FIGS. 9, 11 and 12. (It is to be noted, however, that the present embodiment is applicable to a case where the head is used with a heat pressure not exceeding zero.) An electrical signal is generated with a pulse width, based on said output signal of the pressure sensor, for maintaining a constant ink discharge amount, and is supplied to the recording heaters after amplification in the recording heater driving device.

The ink discharge amount (amount per ink droplet) can therefore be maintained constant, by regulating the driving pulse width for the recording head, according to the head pressure of ink at the discharge ports, indirectly detected by the pressure sensor 3.

Figure 6:
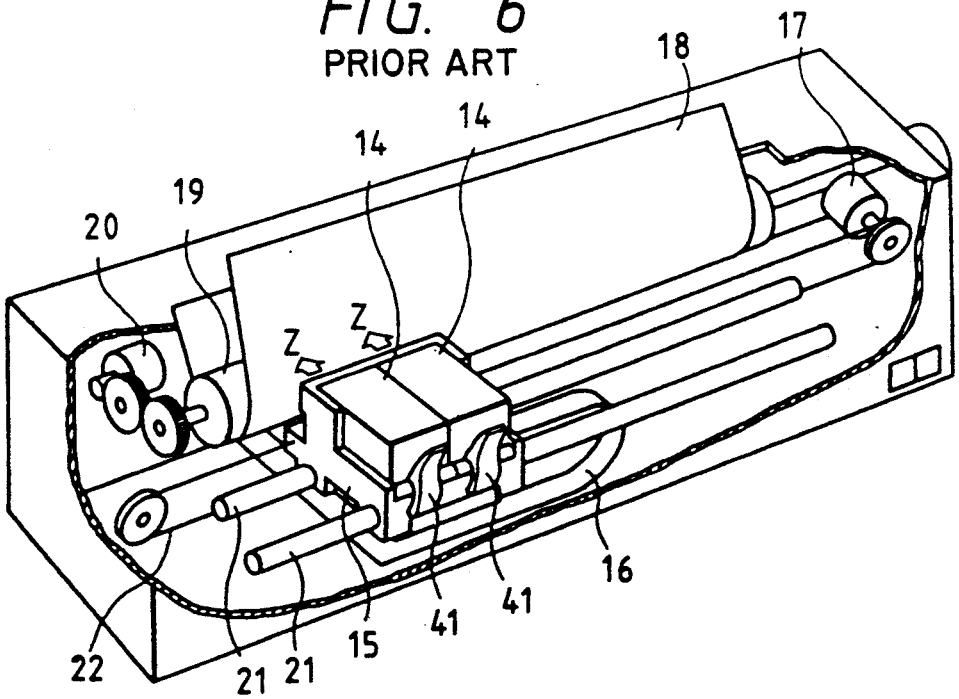
FIG. 6 PRIOR ART
FIG. 6 is a schematic view of an ink jet recording apparatus.

In an ink jet recording apparatus of the structure shown in FIGS. 6 and 7A, 7B (utilizing electrothermal converting devices for generating discharge energy) showing a change in the ink discharge amount from 25 to 18 pl/dot in the ink remaining ratio (ink remaining amount/initial ink amount in the ink tank) of 100 to 30%, the structure shown in FIGS. 1 and 2 was added and the driving pulse width was controlled according to the block diagram shown in FIG. 2. As a result, the change in the ink discharge amount could be reduced to a range of 25–23 pl/dot within the same range of the ink remaining ratio.

The ink absorbent member contained in the ink tank can be so constructed as to provide smooth ink flow toward the recording head, thereby improving the efficiency of ink utilization and the ink discharge characteristics. Such an effect can be realized for example by unevenly compressing the ink absorbent member or by combining it with another member in such a manner that the pore rate of said absorbent member increases toward the recording head.

2nd Embodiment

Figure 3:
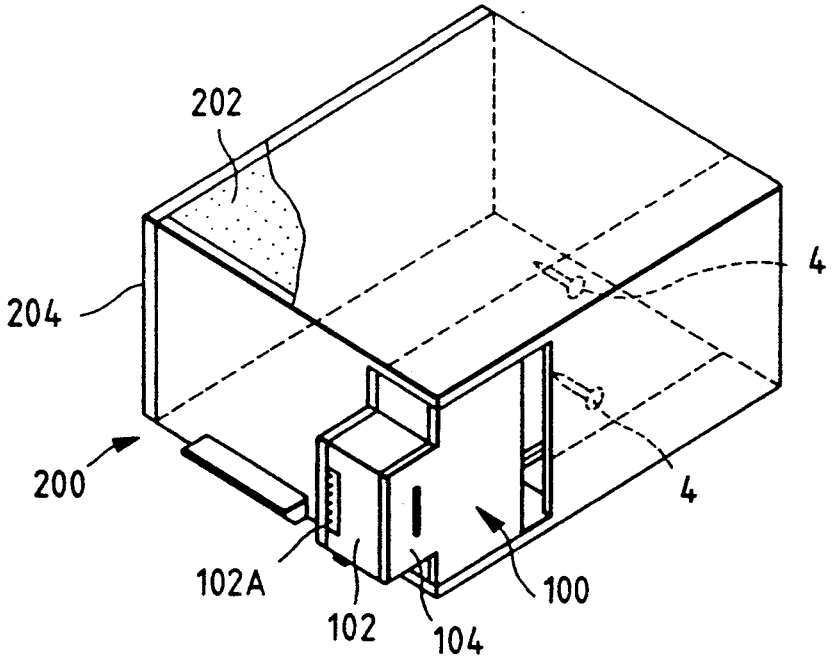
Figure 13:
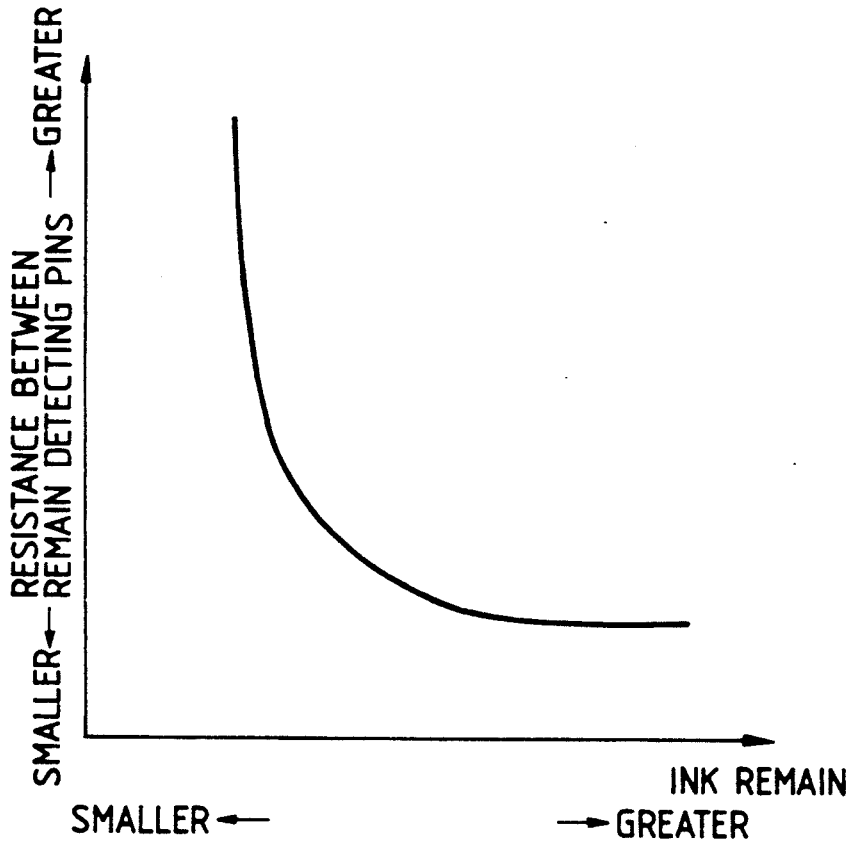

FIG. 3 is a schematic view of the ink tank and the recording head in a second embodiment of the present invention. Detecting pins 4, constituting a pair of electrodes for detecting the remaining amount of ink are inserted into the ink absorbent member 200 in the ink tank. The electrical resistance between the detecting pins 4 varies according to the decrease of ink in the absorbent member 200. FIG. 13 shows an example of the relationship between the remaining amount of ink in the absorbent member and the resistance between the detecting pins. As the resistance between the detecting pins 4 rapidly increases with a decrease in remaining ink, the head pressure of ink can be estimated from the resistance. Except for said detecting pins 4, the structure is same as that shown in FIG. 7B. Also in this embodiment, the ink discharge amount from the discharge ports can be regulated by varying the driving condition of the recording head, for example the drive frequency or the pulse width for the discharge energy generating members according to the head pressure of ink at the discharge ports.

Figure 4:
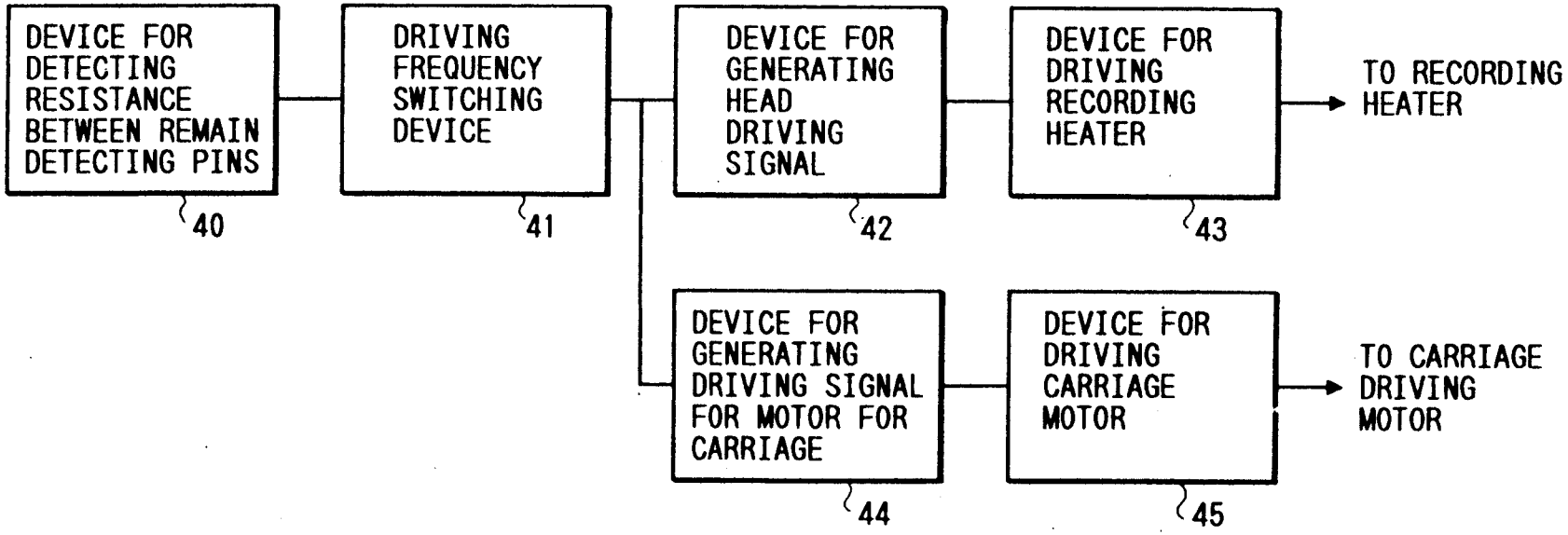
Figure 8:
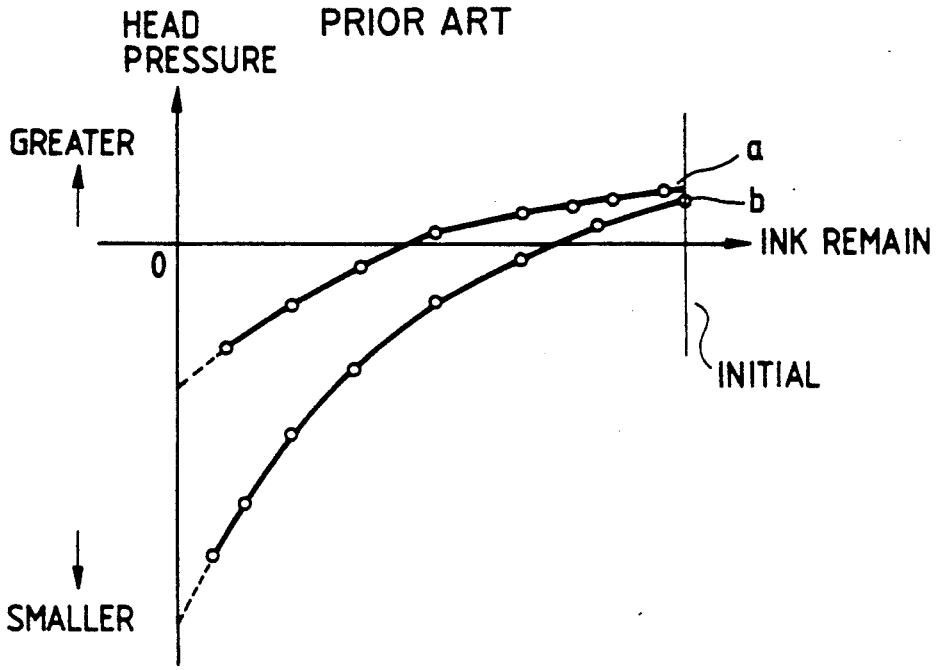
FIG. 8 PRIOR ART
FIGS. 8 to 13 are charts showing the influences of various parameters on the head pressure of ink at the discharge ports.
Figure 10:
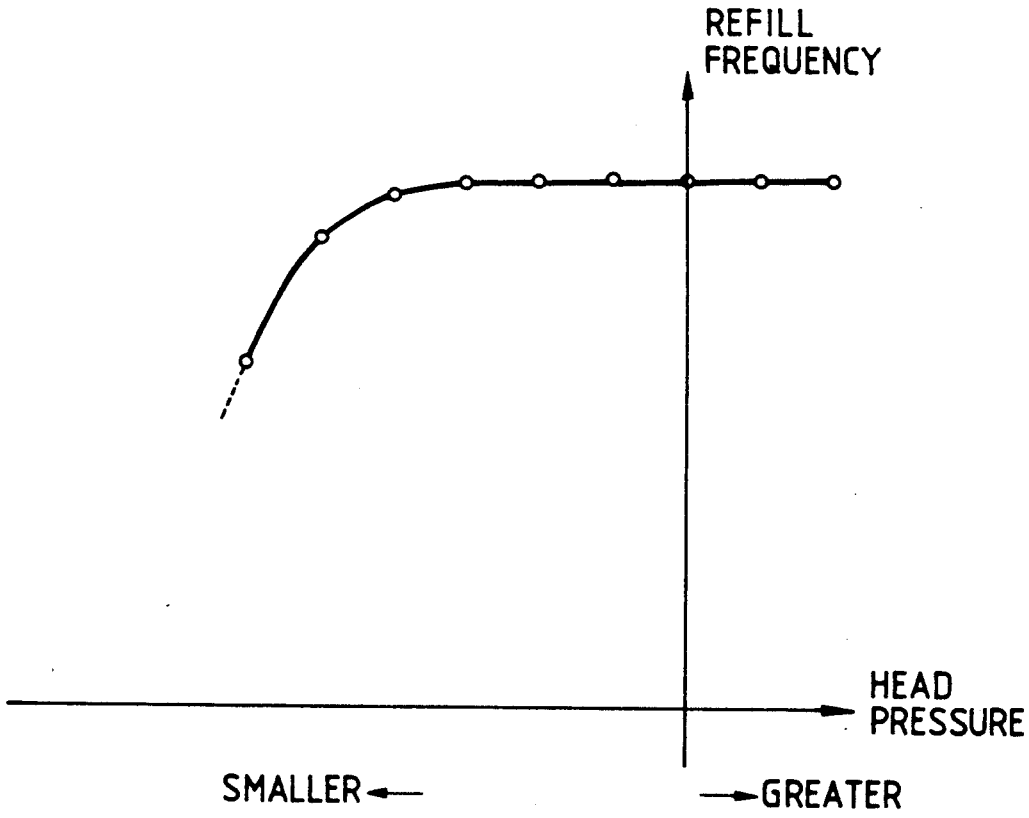

FIG. 4 is a block diagram for a device for controlling the drive frequency of the recording head and the carriage moving speed in the second embodiment, wherein shown are a detecting device 41 for the detecting the resistance between the detecting pins; a driving frequency switching device 41; a head driving signal generating device 42; a recording heater driving device 43; a carriage motor driving signal generating device 44; and a carriage motor driving device 45. The resistance between the detecting pins is converted by the detecting device 40 into a signal which is supplied to the frequency switching device 41. The device 41 compares the resistance corresponding to the input signal with a predetermined reference resistance, and sends a frequency switching signal to the signal generating devices 42, 44 in case the resistance corresponding to the input signal is larger. The reference resistance can be determined from the resistance between the detecting pins corresponding to the head pressure at the discharge ports, just in front of the rapid decrease in the ink refilling frequency, as well as from the relationships shown in FIGS. 8, 10 and 13. In response to the frequency switching signal, the head driving signal generating device 42 and the carriage motor drive signal generating device 44 respectively generate drive signals for driving the discharge energy generating members with a frequency for maintaining a substantially constant ink discharge amount and for reducing the revolution of the carriage motor for obtaining a carriage speed providing a normal image in response to the frequency, and send the drive signals respectively to the driving devices 43, 45. The drive signal is supplied to the recording heaters after suitable amplification in the recording heater drive device. Also, the other drive signal is supplied to the carriage motor after conversion into a stepping motor driving signal, in the carriage motor driving device. In this manner the recording heaters and the carriage movement are switched to a predetermined condition, for example for obtaining a constant ink discharge amount.

The above-explained control of the head driving frequency and the carriage driving speed according to the head pressure of ink indirectly detected by a sensor detecting the ink remaining amount prevents ink discharge failure resulting from a decrease in the refilling frequency, to improves the efficiency of ink utilization, and achieves image recording without a significant change in the ink discharge amount. Also, the cost of the apparatus can be reduced since the head pressure of ink is indirectly detected by the sensor for the ink remaining amount, instead of an exclusive sensor for the head pressure.

The structure shown in FIGS. 3 and 4 was added to an ink jet recording apparatus of the structure shown in FIGS. 6 and 7A, 7B (utilizing electrothermal converting members for generating energy for ink discharge), and the resulting devices exhibited a change in the ink discharge amount from 20 to 10 pl/dot in the above-defined ink remaining ratio from 40 to 20%, and became incapable of ink discharge at an ink remaining ratio of 20% or lower. The switching of the frequency for driving the energy generating members and the carriage moving speed (by reducing the frequency to 2/3 at the ink remaining ratio of 40%) could control the ink discharge amount within a range from 20 to 15 pl/dot and could maintain the ink discharge down to an ink remaining amount of 10%.

Figure 5:
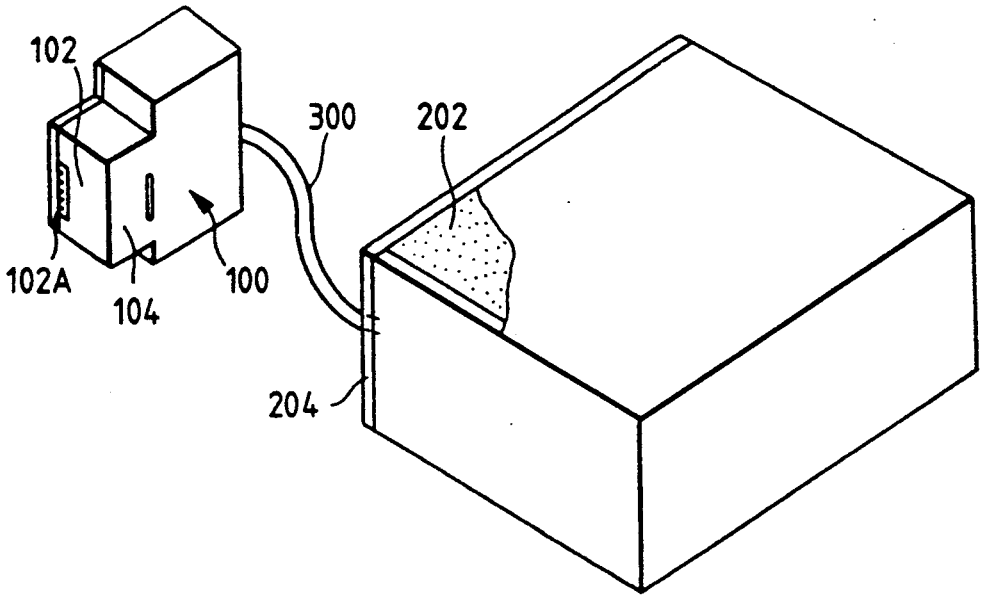

In the foregoing first and second embodiments, the ink tank and the recording head are integrally connected, but the present invention is also applicable to the case in which they are separated and mutually connected by connecting means such as a tube 300, as shown in FIG. 5. Also in the first embodiment, a similar effect can be obtained not by controlling the driving pulse width for the discharge energy generating members but by controlling the driving voltage, the recording head temperature etc., switched singly or in combination, according to the head pressure of the ink at the discharge ports. Furthermore, the effect of the first embodiment can be further enhanced by combining the frequency switching of the second embodiment. It is furthermore desirable, in the first and second embodiments, for improving the precision of detection, by employing a combination of plural different sensors for detecting the head pressure of ink, such as the pressure sensor shown in FIG. 1 and the detecting pins shown in FIG. 3. An additional advantage is obtained in the first or second embodiment, by employing the switching of driving condition according to the difference in position of the ink tank.

As explained in the foregoing, the present invention provides a method for controlling the driving condition of the recording head according to the change in the head pressure of ink at the discharge ports, and a structure for exploiting the method.

The present invention allows a device to achieve a constant ink discharge amount regardless of the change in the remaining ink amount in the ink tank, thereby realizing ink jet recording with uniform image density. Also, the present invention prevents the failure in ink discharge resulting from the decrease in head pressure of ink at the discharge ports, thereby enabling to use more ink in the ink tank, and reducing the operating cost of an ink jet recording apparatus utilizing an ink tank incorporating an ink absorbent member.

Among various ink jet recording methods, the present invention is particularly advantageous for the recording head and recording apparatus of a bubble jet recording method.

The basic structure and working principle of this recording method are for example disclosed in the U.S. Pat. Nos. 4,723,129 and 4,740,796. This recording method is applicable to either of so-called on-demand recording and continuous recording, but is particularly useful in application to the on-demand recording, since an electrothermal converting member provided in a liquid path or on a sheet bearing liquid (ink) thereon is given at least a driving signal corresponding to the recording information and induce a rapid temperature increase exceeding the boiling point of the liquid, thereby generating thermal energy in the converting member and causing the liquid to boil on a thermal action face of the recording head, thereby generating a bubble in the liquid in one-to-one correspondence to the drive signal. The expansion and contraction of the bubble are utilized to discharge the liquid (ink) through the discharge port, thereby forming at least a droplet. The drive signal is preferably formed as a pulse, since the expansion and contraction of the bubble can be made instantaneously, thus achieving ink discharge with superior response. Such a pulse-shaped drive signal is preferably that disclosed in the U.S. Pat. Nos. 4,463,359 and 4,345,262. Also, still further improved recording can be achieved by employing the condition disclosed in the U.S. Pat. No. 4,313,124 with respect to the temperature elevation rate of the thermal action face.

The structure of the recording head is not limited to the combination of discharge ports, liquid paths and electrothermal converting members, including linear or rectangular liquid paths, as disclosed in the above-mentioned patents, but also includes the structure in which the thermal action areas are provided in bent areas, as disclosed in the U.S. Pat. Nos. 4,558,333 and 4,459,600. Furthermore, the present invention is applicable also to a structure in which a slit common to plural electrothermal converting members constitutes discharge parts for the converting members, as disclosed in the Japanese Laid-open Patent Sho 59-123670, or a structure in which apertures for absorbing pressure waves resulting from thermal energy are provided corresponding to the discharge ports, as disclosed in the Japanese Laid-open Patent Sho 59-138461.

Furthermore, a full-line recording head of a length corresponding to the width of the largest recording medium recordable on the recording apparatus can be realized by the combination of plural recording heads as disclosed in the above-mentioned patents or by a single integral recording head, and the present invention can be more effectively applicable to such recording heads.

The present invention is furthermore applicable to a chip-type replaceable recording head which can be electrically connected to the apparatus and can receive ink supplied therefrom upon mounting on the recording apparatus, or a recording head of an integral cartridge type.

Also, in the structure of the recording apparatus, the presence of recovery means or preparatory auxiliary means for the recording head is preferable, as they further stabilize the effect of the present invention. More specifically, there is preferred, for stable recording, the use of capping means for the recording head, cleaning means, pressurizing or sucking means, electrothermal converting members or other heating elements, or preliminary heating means composed of combinations thereof, or the execution of a preliminary ink discharge operation different from the recording operation.

Furthermore, the present invention is extremely effective not only for a recording mode using a main color such as black, but also for recording apparatus recording in plural colors for which there may be provided a single integral recording head or plural recording heads.

We claim:

1. An ink jet recording method comprising the steps of:

providing an ink jet recording apparatus capable of generating a recording signal representing information to be recorded, the apparatus having a support member, and an ink cartridge having an integral ink tank for containing ink and recording head portion for discharging ink contained in the ink tank, wherein the recording head portion includes a discharge port and an energy generating member for discharging ink through the discharge port in response to the recording signal, the ink cartridge being adapted for interchangeable mounting on the support member;

detecting the head pressure of ink proximate to the discharge port using sensor means, said sensor means producing a head pressure signal; and adjusting the recording signal to maintain substantially constant discharge of ink in response to the head pressure signal produced by the sensor means.

2. An ink jet recording method according to claim 1, wherein the sensor means comprises a pressure detecting sensor, wherein the head pressure signal produced thereby represents the head pressure at the discharge port and wherein said adjusting step adjusts the recording signal when the head pressure at the discharge port is lower than a reference pressure.

3. An ink jet recording head according to claim 1, wherein said sensor means comprises an ink amount detector for detecting the remaining amount of ink in the ink tank, wherein the amount of ink detected by the ink amount detector represents the head pressure at the discharge port and wherein said adjusting step adjusts the recording signal when the head pressure at the discharge port is lower than a reference pressure.

4. An ink jet recording method according to claim 1, wherein said adjusting step comprises the step of adjusting one of a driving pulse width, driving frequency or driving voltage of the recording signal to maintain the amount of ink discharged from the discharge port within a range of 15 to 25 pl without regard to the amount of ink in the ink tank.

5. An ink jet recording method according to claim 1, further comprising the step of regulating the scanning speed of a carriage supporting the cartridge, wherein said adjusting step and said scanning speed regulating step are performed according to the ink refilling frequency characteristics of the ink tank.

6. An ink jet recording apparatus capable of generating a recording signal representing information to be recorded, the apparatus comprising:

a support member;

an ink cartridge having an integral ink tank for containing ink and recording head portion for discharging ink in said ink tank, wherein said recording head portion includes a discharge port and an energy generating member for discharging ink through said discharge port in response to the recording signal, said ink cartridge being adapted for interchangeable mounting on said support member;

sensor means for detecting the head pressure of ink proximate to said discharge port, said sensor means producing a head pressure signal; and adjusting means for adjusting the recording signal to maintain substantially constant discharge of ink in response to the head pressure signal produced by said sensor means.

7. An ink jet recording apparatus according to claim 6, wherein said sensor means comprises a pressure detecting sensor and the head pressure signal produced thereby represents the head pressure at said discharge port, said adjusting means being adapted to adjust the recording signal when the head pressure at said discharge port is lower than a reference pressure.

8. An ink jet recording apparatus according to claim 6, wherein said sensor means comprises an ink amount detector for detecting the remaining amount of ink in said ink tank and the amount of ink detected by said ink amount detector is presumed equivalent to the head pressure at said discharge port, said adjusting means being adapted to adjust the recording signal when the head pressure at said discharge port is lower than a reference pressure.

9. An ink jet recording apparatus according to claim 6, further comprising an absorbent member having a predetermined ink absorbability in said ink tank, wherein the absorbability of said absorbent member provides a flow of ink from said ink tank to said recording head portion.

10. An ink jet recording apparatus according to claim 6, wherein said adjusting means is adapted to adjust one of a driving pulse width, driving frequency or driving voltage of the recording signal to maintain the amount of ink discharged from said discharge port within a range from 15 to 25 pl without regard to the amount of ink in said ink tank.

11. An ink jet recording apparatus according to claim 1, further comprising a carriage capable of supporting said cartridge and of performing a scanning motion, wherein said adjusting means comprises means for regulating the driving frequency of the recording signal, and means for regulating the scanning speed of said carriage according to the ink refilling frequency characteristics corresponding to the driving frequency.

12. An ink jet recording apparatus according to claim 1, wherein said energy generating member comprises an electrothermal converting member for generating thermal energy to be utilized as the discharge energy for the ink.

* * * * *

UNITED STATES PATENT AND TRADEMARK OFFICE

CERTIFICATE OF CORRECTION

PATENT NO. : 5,179,389

DATED : January 12, 1993

INVENTOR(S) : ATSUSHI ARAI, ET AL.

It is certified that error appears in the above-identified patent and that said Letters Patent is hereby corrected as shown below:

IN [57] ABSTRACT

Line 8, "the" should read --a--.
Line 9, "a" should read --the--.

COLUMN 1

Line 18, "and and" should read --and an--.
Line 42, "14" should read --15--.

COLUMN 3

Line 57, "utilizing" should read --utilized--.

COLUMN 4

Line 6, "discharge" should read --discharge the ink droplets having the same amount--.
Line 9, "ink can" should read --ink utilization can be improved since a larger amount of ink can--.

COLUMN 6

Line 51, "to" should be deleted.

COLUMN 7

Line 56, "induce" should read --induces--.

COLUMN 9

Line 15, "head" should read --method--.

UNITED STATES PATENT AND TRADEMARK OFFICE

CERTIFICATE OF CORRECTION

PATENT NO. : 5,179,389

DATED : January 12, 1993

INVENTOR(S) : ATSUSHI ARAI, ET AL.

It is certified that error appears in the above-identified patent and that said Letters Patent is hereby corrected as shown below:

COLUMN 10

Line 38, "1," should read --6,--.
Line 46, "1," should read --6,--.

Signed and Sealed this

Twenty-third Day of November, 1993

*Attest:*

*Attesting Officer*

BRUCE LEHMAN

*Commissioner of Patents and Trademarks*